US008534573B2

(12) United States Patent
Wang et al.

(10) Patent No.: US 8,534,573 B2
(45) Date of Patent: Sep. 17, 2013

(54) SPRINKLER HAVING ADJUSTABLE SPRINKLING PATTERN

(75) Inventors: Po-Hsiung Wang, Miao-Li Hsien (TW); Tzu-Meng Wang, Miao-Li Hsien (TW)

(73) Assignee: Kwan-Ten Enterprise Co., Ltd., Chu-Nan Chen, Miao-Li Hsien (TW)

( * ) Notice: Subject to any disclaimer, the term of this patent is extended or adjusted under 35 U.S.C. 154(b) by 973 days.

(21) Appl. No.: 12/618,924

(22) Filed: Nov. 16, 2009

(65) Prior Publication Data

US 2011/0095101 A1 Apr. 28, 2011

(30) Foreign Application Priority Data

Oct. 23, 2009 (TW) ..... 98135909 A

(51) Int. Cl.

| | |
|---|---|
| ***B05B 3/16*** | (2006.01) |
| ***B05B 3/00*** | (2006.01) |
| ***B05B 3/04*** | (2006.01) |
| ***B05B 1/32*** | (2006.01) |
| ***B05B 15/00*** | (2006.01) |
| ***B05B 1/20*** | (2006.01) |
| ***B05B 1/14*** | (2006.01) |
| ***B05B 1/00*** | (2006.01) |

(52) U.S. Cl.

USPC ..... 239/242; 239/227; 239/240; 239/247; 239/248; 239/455; 239/546; 239/566; 239/568; 239/602; 239/DIG. 1; 239/DIG. 12

(58) Field of Classification Search

USPC ..... 239/242, 225.1, 227, 240, 246–248, 239/451, 455, 546, 548, 550, 551, 553, 239/562, 566, 567, 568, 581.1, 602, DIG. 1, 239/DIG. 12, 443

See application file for complete search history.

(56) References Cited

U.S. PATENT DOCUMENTS

| | | | | |
|---|---|---|---|---|
| 6,062,490 | A | 5/2000 | Katzer et al. | |
| 6,135,356 | A | 10/2000 | Mitzlaff et al. | |
| 7,258,286 | B1 | 8/2007 | Wang et al. | |
| 7,284,714 | B1 | 10/2007 | Wang et al. | |
| 7,909,266 | B2 * | 3/2011 | Lo | 239/242 |
| 2011/0248102 | A1 * | 10/2011 | Wang | 239/562 |

* cited by examiner

*Primary Examiner* — Jason J Boeckmann
*Assistant Examiner* — Steven M Cernoch
(74) *Attorney, Agent, or Firm* — C. G. Mersereau; Nikolai & Mersereau, P.A.

(57) ABSTRACT

A sprinkler has a sprinkling device, and an inlet controlling device and an end cap respectively mounted on two opposite ends of the sprinkling device. The sprinkling device has a casing having outlet holes, and two regulating panels having regulating slots, two regulating wheels, two transmission rods and a cover having limit slots mounted on the casing. The outlet holes, the regulating slots and the limit slots respectively align with each other and are mounted around multiple nozzles. Turning the regulating wheels forces the nozzles to bend through the regulating panels so the sprinkler has a variety of sprinkling patterns to be suitable for every place where the sprinkler is placed. The nozzles are individually manufactured and are easily mounted on the casing and replaced.

20 Claims, 11 Drawing Sheets

SPRINKLER HAVING ADJUSTABLE SPRINKLING PATTERN

BACKGROUND OF THE INVENTION

1. Field of the Invention

The present invention relates to a sprinkler having an adjustable sprinkling pattern, especially to a sprinkler that is able to bend nozzles in the sprinkler to adjust the sprinkling pattern of the sprinkler.

2. Description of the Prior Art(s)

Sprinklers are mainly used in irrigating planes such as meadows, fields, lawns or the like to keep the planes moist. The sprinkler is connected to a water supply controlled to flow into the sprinkler by an auto control system or by hand and to exit the sprinkler.

A conventional sprinkler shown in "METHOD FOR ADJUSTING THE SPRINKLING PATTERN OF A SPRINKLING APPARATUS AND SPRINKLING APPARATUS" (U.S. Pat. No. 6,135,356) has a casing, a cover, a regulating panel and a nozzle arrangement. The casing is tubular has multiple through holes and two oblique guiding slots respectively defined adjacent to two opposite ends of the casing. The cover is mounted on the casing and has multiple limit slots respectively aligning with the through holes of the casing. The regulating panel is mounted between the casing and the cover and has two guiding protrusions and multiple regulating slots. The guiding protrusions are respectively mounted through the guiding slots of the casing so the guiding protrusions slide along the guiding slots. The regulating slots also respectively align with the through holes of the casing. Each regulating slot has an axis oblique to an axis of the limit slot of the cover. The nozzle arrangement is elongated and integrally formed, is mounted in the casing and has multiple nozzles respectively mounted through corresponding through hole of the casing, regulating slot of the regulating panel and limit slot of the cover.

Water flows into the casing and out of the sprinkler through the nozzles. When the regulating panel is pushed, edges defined around the regulating holes of the regulating panel force the nozzles to change sprinkling directions of the nozzles. Thus, only pushing one end of the regulating panel and pushing both ends of the regulating panel form different types of sprinkling patterns.

However, since the conventional sprinkler has only one regulating panel, the sprinkling patterns of the sprinkler are limited and are not suitable for every place where the sprinkler is placed. Moreover, the nozzle arrangement is integrally formed. Therefore, when relative positions of the nozzles are inaccurate, some of the nozzles may not protrude through the through holes of the casing, the regulating slots of the regulating panel and limit slots of the cover or some of the nozzles may be bent so disrupting sprinkling patterns. In addition, once one of the nozzles is broken, the nozzle arrangement should be replaced, which costs a lot.

To overcome the shortcomings, the present invention provides a sprinkler having an adjustable sprinkling pattern to mitigate or obviate the aforementioned problems.

SUMMARY OF THE INVENTION

The main objective of the present invention is to provide a sprinkler having an adjustable sprinkling pattern.

The sprinkler has a sprinkling device, and an inlet controlling device and an end cap respectively mounted on two opposite ends of the sprinkling device. The sprinkling device has a casing having outlet holes, and two regulating panels having regulating slots, two regulating wheels, two transmission rods and a cover having limit slots mounted on the casing. The outlet holes of the casing, the regulating slots of the regulating panels and the limit slots of the cover respectively align with each other and are mounted around multiple nozzles.

Turning the regulating wheels forces the nozzles to bend through the regulating panels so the sprinkler has a variety of sprinkling patterns to be suitable for every place where the sprinkler is placed. The nozzles are individually manufactured and are easily mounted on the casing and replaced.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
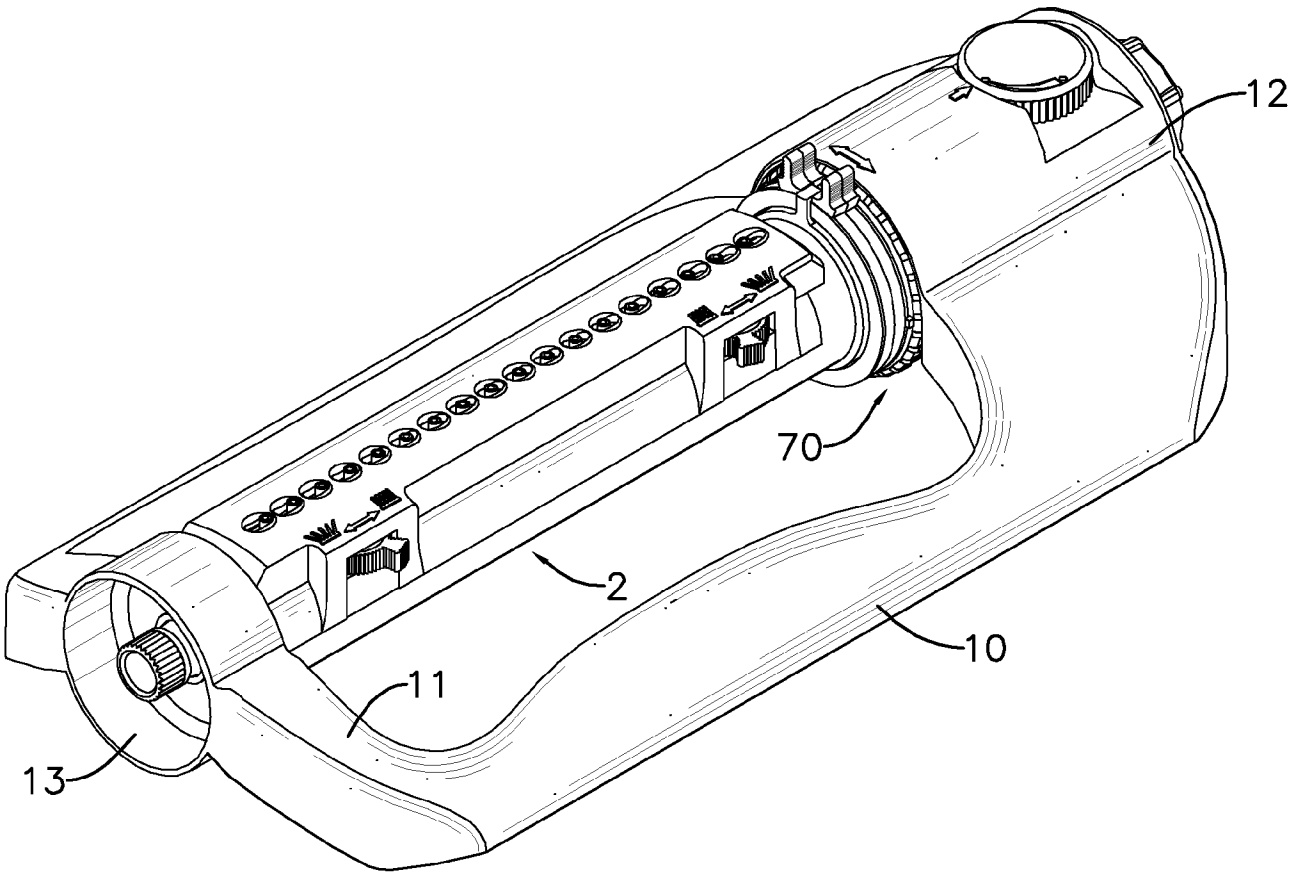
FIG. 1 is a perspective view of a sprinkler having an adjustable sprinkling pattern in accordance with the present invention.
Figure 2:
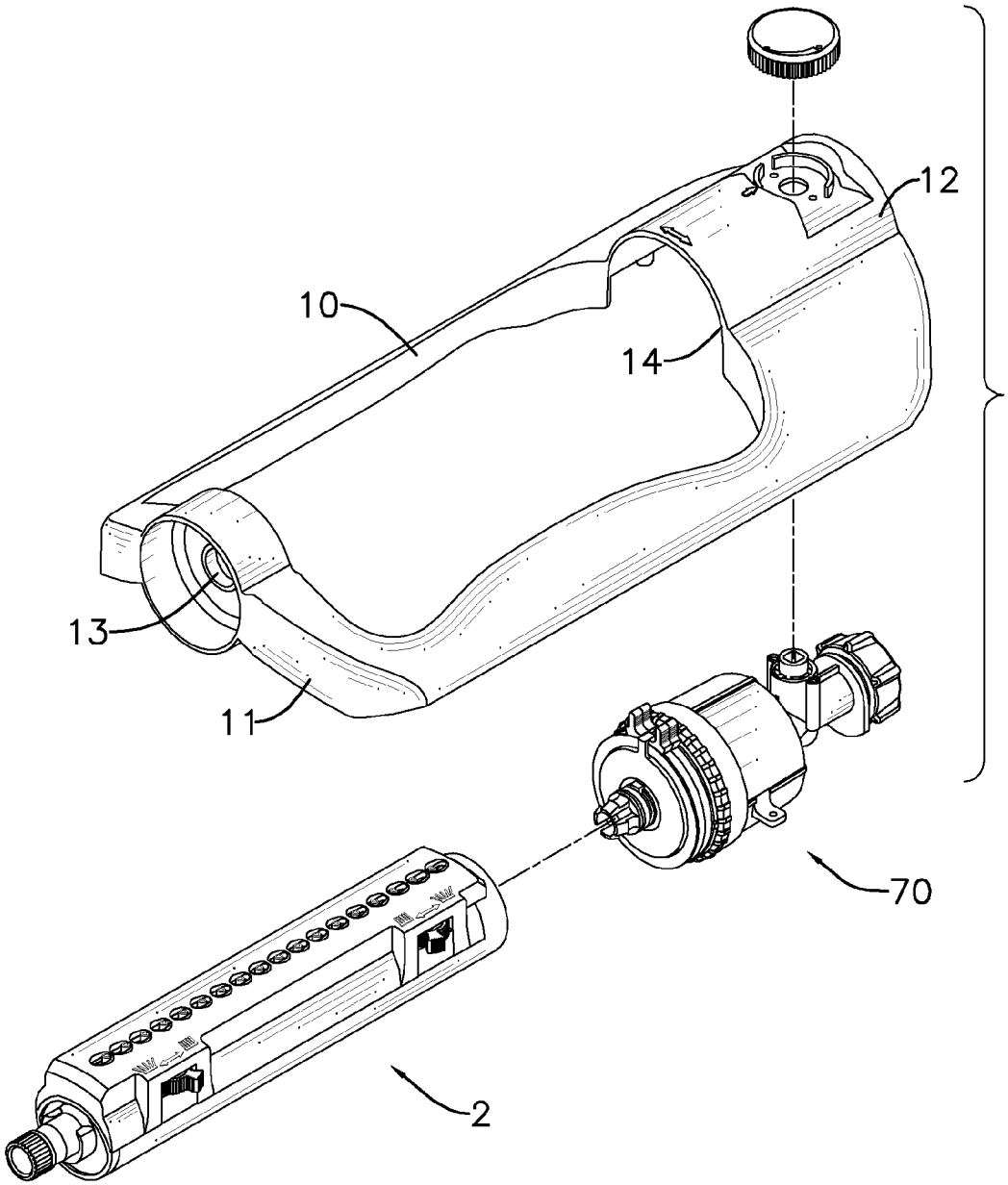
FIG. 2 is a partially exploded perspective view of the sprinkler in FIG. 1.

With reference to FIGS. 1 and 2, a sprinkler having an adjustable sprinkling pattern in accordance with the present invention comprises a frame (10), sprinkling device (2) and an inlet controlling device (70).

The frame (10) has a positioning hole (13) and a mounting recess (14). The positioning hole (13) is formed through a rear end (11) of the frame (10). The mounting recess (14) is formed in a lower surface adjacent to a front end (12) of the frame (10).

Figure 3:
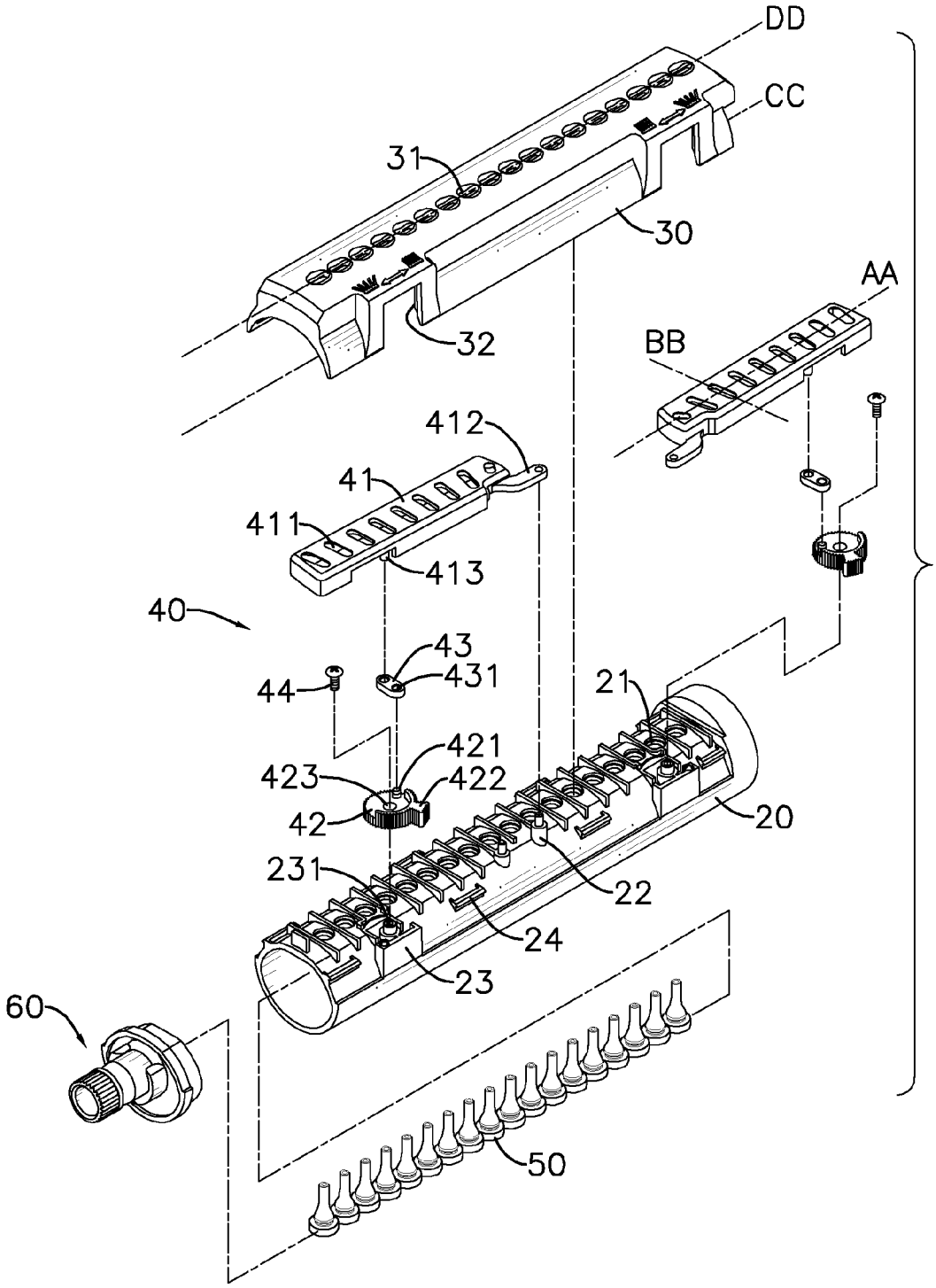
FIG. 3 is an exploded perspective view of a sprinkling device of the sprinkler in FIG. 1.

With further reference to FIG. 3, the sprinkling device (2) is mounted between the front and rear ends (12, 11) of the frame (10) and has a casing (20), an end cap (60), two regulating panels (41), two regulating wheels (42), two fasteners (44), two transmission rods (43), a cover (30) and multiple nozzles (50).

The casing (20) is tubular and has multiple outlet holes (21), two pivot rods (22), two positioning parts (23) and multiple latches (24).

The outlet holes (21) are formed through and linearly arranged along the casing (20). The pivot rods (22) protrude from an outer surface of the casing (20), beside the outlet holes (21) and adjacent to a middle of the casing (20).

Figure 5:
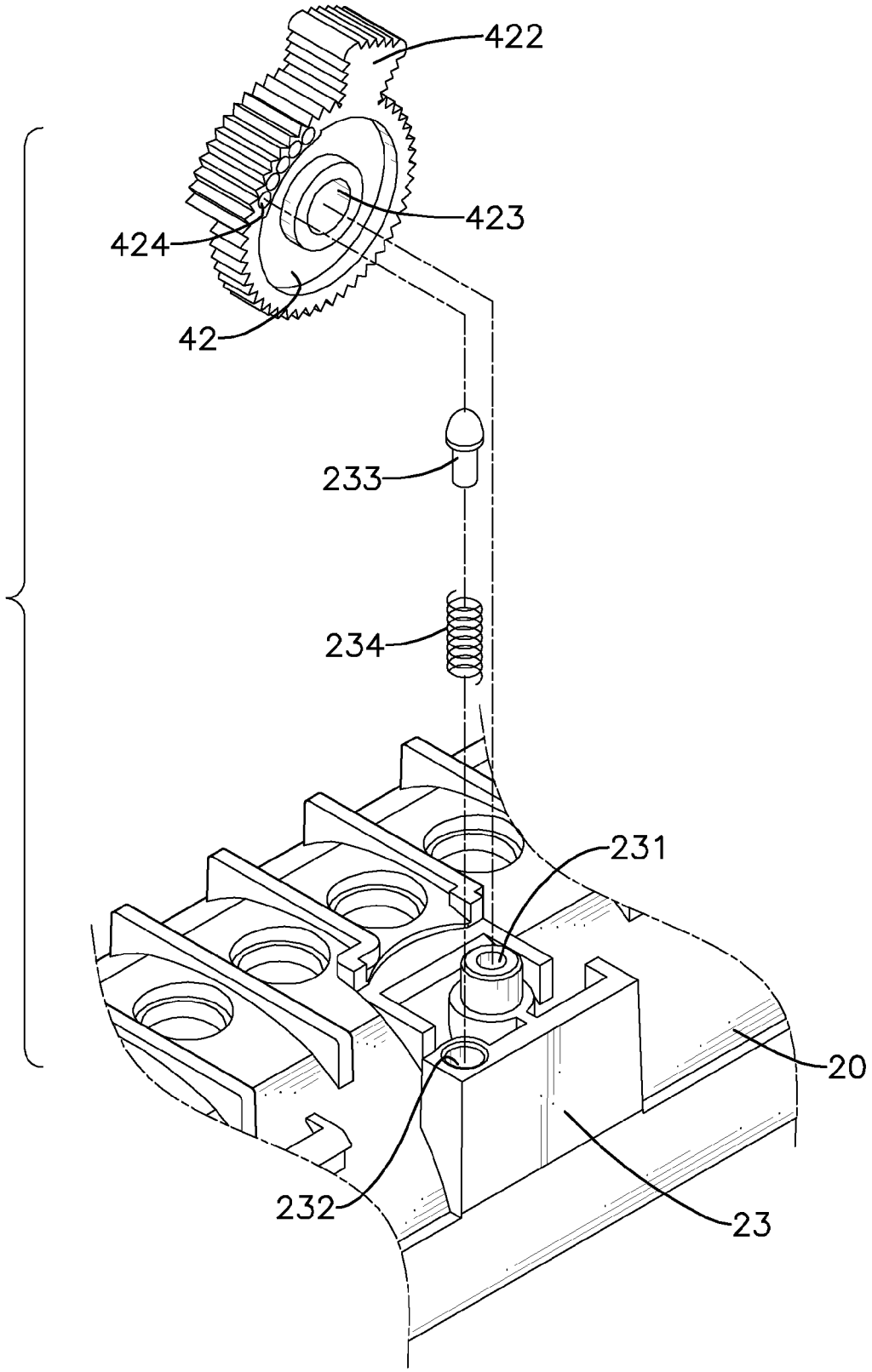
FIG. 5 is an enlarged exploded perspective view of the sprinkling device in FIG. 3.

With further reference to FIG. 5, the positioning parts (23) are formed on the outer surface of the casing (20), beside the outlet holes (21) and respectively adjacent to a rear end and a front end of the casing (20). Each positioning part (23) has a pivot hole (231), a holding recess (232), a holding rod (233) and a resilient element (234). The pivot hole (231) of the positioning part (23) and the holding recess (232) are formed in the positioning part (23). The holding rod (233) is mounted in the holding recess (232). The resilient element (234) is mounted in the holding recess (232) and pushes the holding rod (233) outwardly.

Figure 6:
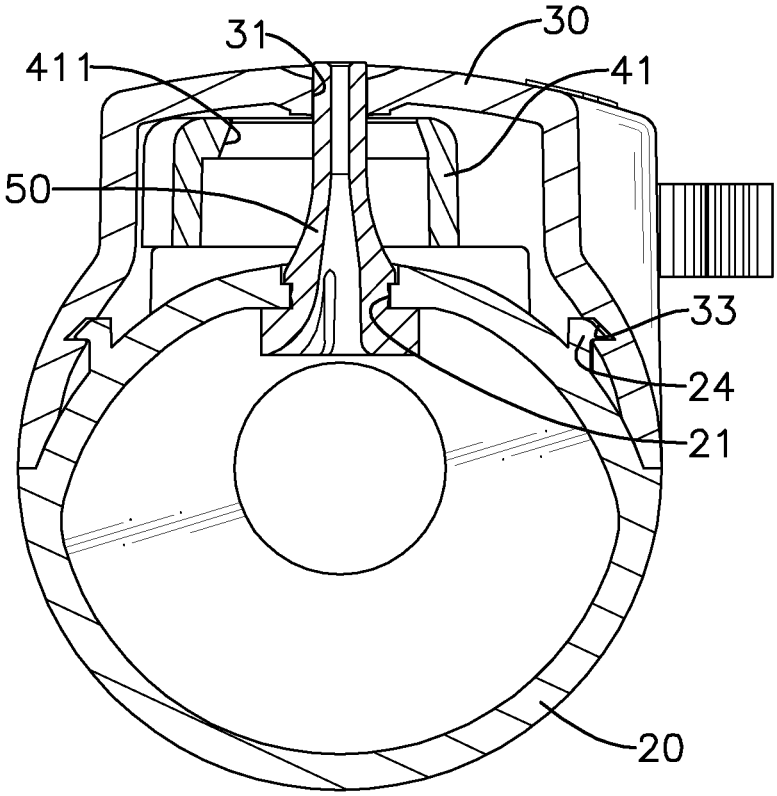
FIG. 6 is a cross-sectional end view of the sprinkling device in FIG. 3.

With further reference to FIG. 6, the latches (24) are formed on the outer surface and beside the outlet holes (21) of the casing (20).

The end cap (60) is securely mounted on and seals a rear end of the casing (20) and is mounted in the positioning hole (13) of the frame (10).

Figure 4:
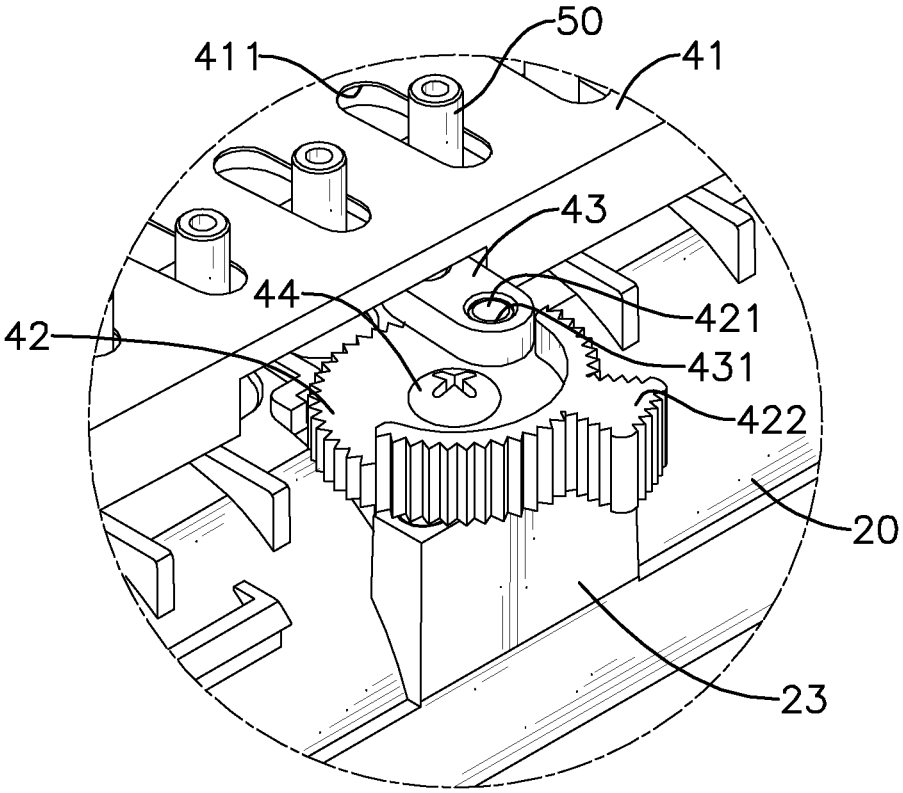
FIG. 4 is an enlarged perspective view of the sprinkling device in FIG. 3.

With further reference to FIG. 4, the regulating panels (41) are mounted on the casing (20) and respectively between the pivot rods (22) and the positioning parts (23) of the casing (20). Each regulating panel (41) is elongated and has a panel axis (AA), multiple regulating slots (411), a pivot bar (412) and a connecting post (413).

The regulating slots (411) are formed through and linearly arranged along the regulating panel (41) and respectively align with the outlet holes (21) of the casing (20). Each regulating slot (411) has a slot axis (BB). The slot axis (BB) is oblique to the panel axis (AA) of the regulating panel (41) and toward a corresponding end of the regulating panel (41). The closer the regulating slots (411) to a middle of the regulating panel (41), the closer an included angle between the slot axes (BB) and the panel axis (AA) to 90 degrees.

The pivot bar (412) is formed on an inner end of the regulating panel (41) and is pivotally connected to a corresponding pivot rod (22) of the casing (20) so the regulating panel (41) pivots relative to the casing (20).

The connecting post (413) of the regulating panel (41) protrudes from a lower surface of the regulating panel (41) and corresponds to a corresponding positioning part (23) of the casing (20).

The regulating wheels (42) are pivotally mounted on the casing (20) and may be respectively mounted pivotally on the positioning parts (23) of the casing (20). Each regulating wheel (42) has a connecting post (421), an operating lever (422), a pivot hole (423) and multiple holding indentations (424).

The connecting post (421) of the regulating wheel (42) protrudes from an outer surface and adjacent to a peripheral edge of the regulating wheel (42).

The operating lever (422) radially protrudes from the peripheral edge of the regulating wheel (42).

The pivot hole (423) of the regulating wheel (42) is formed through the regulating wheel (42) and aligns with the pivot hole (231) of a corresponding positioning part (23).

The holding indentations (424) are formed in an inner surface of the regulating wheel (42) and correspond to and selectively engage the holding rod (233) of the corresponding positioning part (23).

The fasteners (44) are respectively mounted through the pivot holes (423, 231) of the regulating wheels (42) and the positioning parts (23) and are attached to the casing (20).

The transmission rods (43) are respectively mounted between the regulating panels (41) and the regulating wheels (42). Each transmission rod (43) is pivotally connected to a corresponding regulating panel (41) and a corresponding regulating wheel (42) and has two connecting holes (431). The connecting holes (431) are formed through the transmission rod (43) and respectively adjacent to two opposite ends of the transmission rod (43) and are respectively mounted around the connecting posts (413, 421) of the corresponding regulating panel (41) and the corresponding regulating wheel (42).

The cover (30) is mounted on the regulating panels (41), is attached to the casing (20) and has an elongated axis (CC), multiple limit slots (31), two protruding recesses (32) and multiple retaining grooves (33).

The limit slots (31) are formed through and linearly arranged along the cover (30) and respectively align with the regulating slots (411) of the regulating panels (41). A limit axis (DD) is defined through the limit slots (31). The limit axis (DD) is parallel to the elongated axis (CC) of the cover (30) and is oblique to the slot axis (BB) of a corresponding regulating slot (411) of the regulating panels (41).

The protruding recesses (32) are formed in a side edge of the cover (30) and respectively correspond to and are mounted around the positioning parts (23) of the casing (20) and the regulating wheels (42).

The retaining grooves (33) are formed in an inner surface of the cover (30) and respectively engage the latches (24) of the casing (20) to securely hold the cover (30) on the casing (20).

Figure 7:
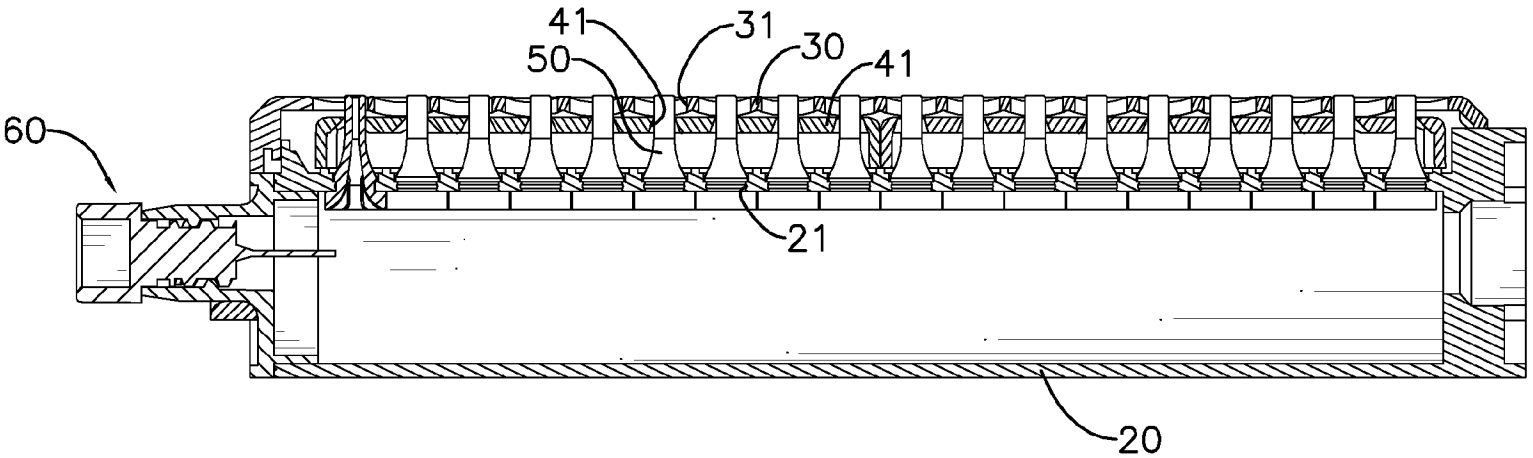
FIG. 7 is a side view in partial section of the sprinkling device in FIG. 3.

With further reference to FIG. 7, the nozzles (50) are bendable, are mounted on and attached to the casing (20) and are respectively mounted through the outlet holes (21) of the casing (20), the regulating slots (411) of the regulating panels (41) and the limit slots (31) of the covers (30).

The inlet controlling device (70) is securely mounted in the mounting recess (14) of the frame (10), is connected to a front end of the casing (20) and a water supply so water flows into the casing (20) and sprinkle around through the nozzles (50).

When pushing the operating levers (422) to turn the regulating wheels (42), the regulating panels (41) pivot simultaneously and the holding rods (233) of the positioning parts (23) engage one of the holding indentations (424) of the regulating wheels (42) to hold the regulating wheels (42) at specific positions. In addition, regulating edges defined around the regulating slots (411) of the regulating panels (41) push and bend the nozzles (50) and the nozzles (50) are retained in the limit slots (31) of the cover (30).

Figure 8:
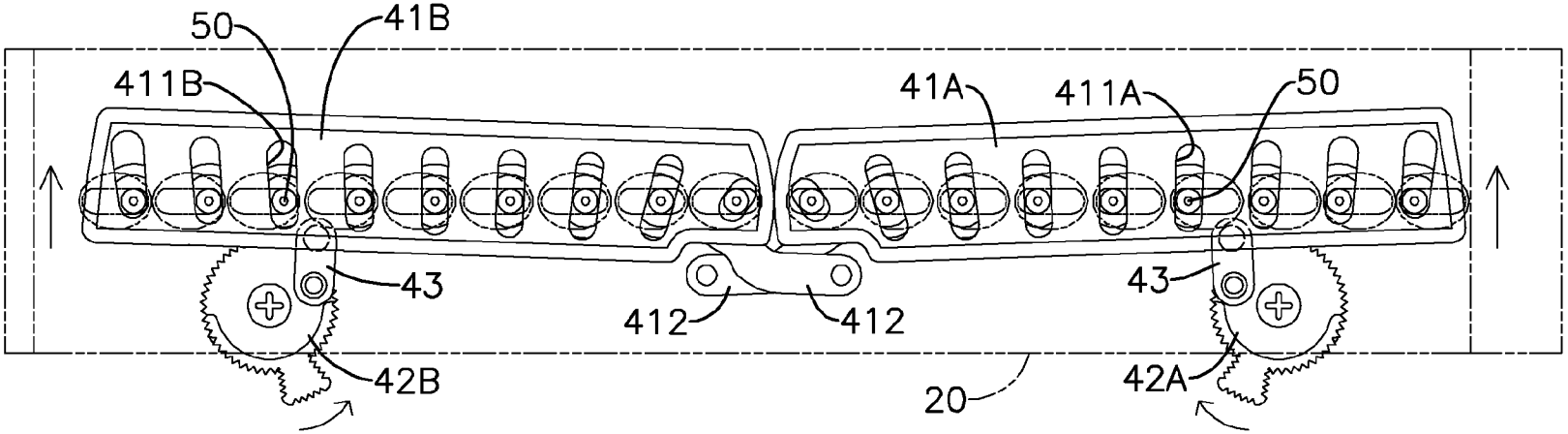
FIG. 8 is a first operational side view in partial section of the sprinkling device in FIG. 3.

With reference to FIG. 8, turning the front regulating wheel (42A) clockwise and the rear regulating wheel (42B) counterclockwise pushes the front and rear regulating panels (41A, 41B) away from the front and rear regulating wheels (42A, 42B). The nozzles are not forced to bend by the regulating edges of the front and rear regulating panels (41A, 41B) and the sprinkler sprinkles the water to a narrower area.

Figure 9:
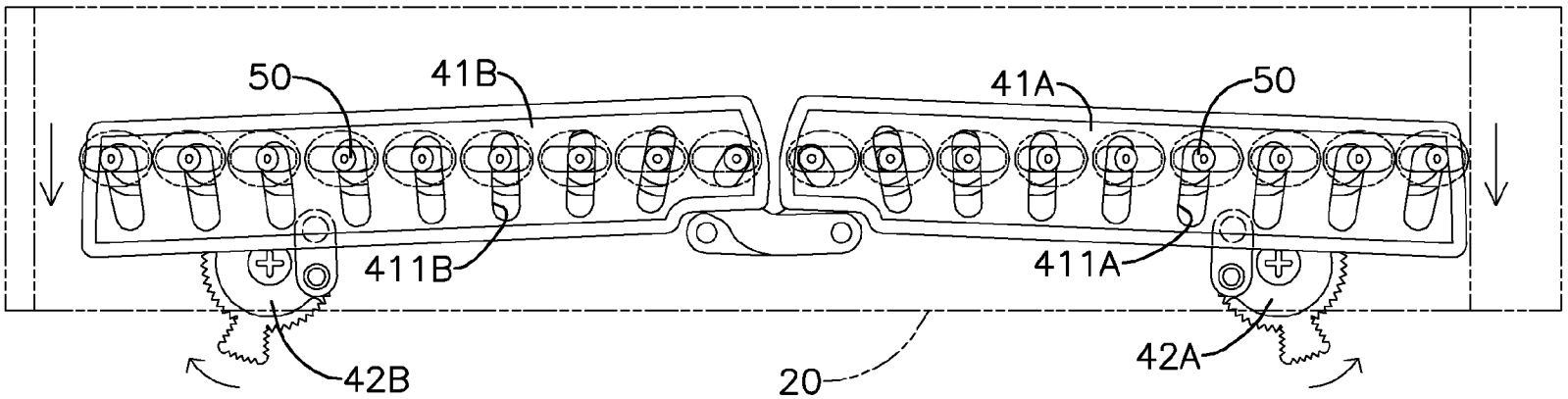
FIG. 9 is a second operational side view in partial section of the sprinkling device in FIG. 3.

With further reference to FIG. 9, turning the front regulating wheel (42A) counterclockwise and the rear regulating wheel (42B) clockwise pull the front and rear regulating panels (41A, 41B) closer to the front and rear regulating wheels (42A, 42B). The nozzles are forced to bend by the regulating edges of the front and rear regulating panels (41A, 41B) and the sprinkler sprinkles the water to a wider area.

Figure 10:
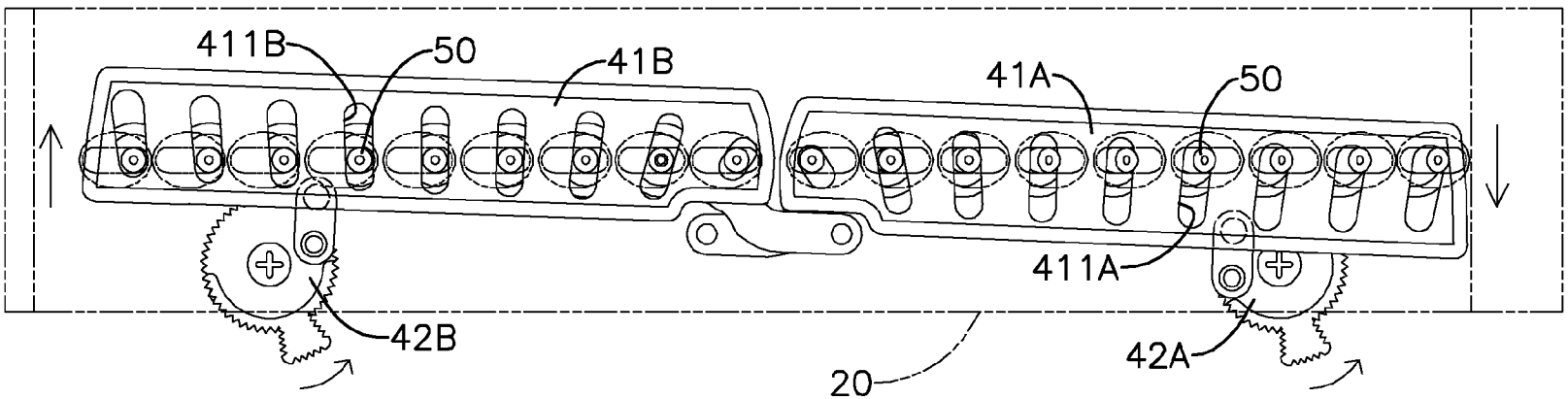
FIG. 10 is a third operational side view in partial section of the sprinkling device in FIG. 3.

With further reference to FIG. 10, turning the front and rear regulating wheels (42A, 42B) counterclockwise pulls the front regulating panel (41A) closer to the front regulating wheel (42A) and pushes the rear regulating panel (41B) away from the rear regulating wheel (42B). The nozzles (50) mounted through the front regulating panel (41A) sprinkle the water to a wider area and the other nozzles (50) mounted through the rear regulating panel (41B) sprinkle the water to a narrower area.

Figure 11:
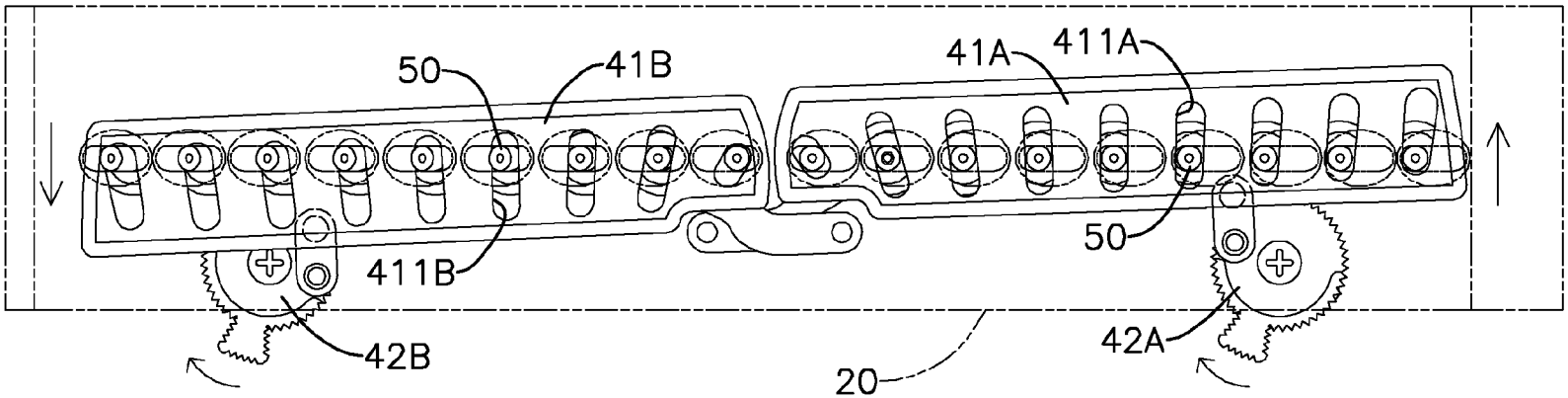
FIG. 11 is a fourth operational side view in partial section of the sprinkling device in FIG. 3.

With further reference to FIG. 11, turning the front and rear regulating wheels (42A, 42B) clockwise pushes the front regulating panel (41A) away from the front regulating wheel (42A) and pulls the rear regulating panel (41B) closer to the rear regulating wheel (42B). The nozzles (50) mounted through the front regulating panel (41A) sprinkle the water to a narrower area and the other nozzles (50) mounted through the rear regulating panel (41B) sprinkle the water to a wider area.

The sprinkler having an adjustable sprinkling pattern as described has the following advantages. The sprinkler has two pairs of regulating panel (41) and regulating wheel (42) respectively control the nozzles (50). Therefore, the sprinkler has a variety of sprinkling patterns to be suitable for every place where the sprinkler is placed. Furthermore, the nozzles (50) are individually manufactured, and therefore, are properly mounted in the casing (20). Once one nozzle (50) is broken, to replace a broken nozzle (50) with a new nozzle (50) is easy and cost saving.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A sprinkler comprising a sprinkling device having a casing being tubular and having multiple outlet holes formed through and linearly arranged along the casing;

an end cap securely mounted on and sealing a rear end of the casing;

two regulating panels pivotally mounted on the casing, and each regulating panel being elongated and having a panel axis; and multiple regulating slots formed through and linearly arranged along the regulating panel and respectively aligning with the outlet holes of the casing, and each regulating slot having a slot axis being oblique to the panel axis of the regulating panel;

two regulating wheels pivotally mounted on the casing;

two transmission rods respectively mounted between the regulating panels and the regulating wheels, and each transmission rod pivotally connected to a corresponding regulating panel and a corresponding regulating wheel;

a cover mounted on the regulating panels, attached to the casing and having an elongated axis; and multiple limit slots formed through and linearly arranged along the cover and respectively aligning with the regulating slots of the regulating panels, and each limit slot having a limit axis being parallel to the elongated axis of the cover and being oblique to the slot axis of a corresponding regulating slot of the regulating panels; and multiple nozzles being bendable, mounted on and attached to the casing and respectively mounted through the outlet holes of the casing, the regulating slots of the regulating panels and the limit slots of the covers; and an inlet controlling device connected to a front end of the casing.

2. The sprinkler as claimed in claim 1, wherein the casing further has two pivot rods protruding from an outer surface of the casing, beside the outlet holes and adjacent to a middle of the casing; and two positioning parts formed on the outer surface of the casing, beside the outlet holes and respectively adjacent to a rear end and a front end of the casing;

the regulating panels are respectively mounted between the pivot rods and the positioning parts of the casing, and each regulating panel further has a pivot bar formed on an inner end of the regulating panel and pivotally connected to a corresponding pivot rod of the casing; and a connecting post protruding from a lower surface of the regulating panel and corresponding to a corresponding positioning part of the casing;

the regulating wheels respectively mounted pivotally on the positioning parts of the casing, and each regulating wheel has a connecting post protruding from an outer surface and adjacent to a peripheral edge of the regulating wheel; and each transmission rod has two connecting holes formed through the transmission rod and respectively adjacent to two opposite ends of the transmission rod and are respectively mounted around the connecting posts of the corresponding regulating panel and the corresponding regulating wheel.

3. The sprinkler as claimed in claim 1, wherein the slot axis of each regulating slot is oblique toward a corresponding end of the regulating panel, and the closer the regulating slots to a middle of the regulating panel, the closer an included angle between the slot axes and the panel axis to 90 degrees.

4. The sprinkler as claimed in claim 2, wherein the slot axis of each regulating slot is oblique toward a corresponding end of the regulating panel, and the closer the regulating slots to a middle of the regulating panel, the closer an included angle between the slot axes and the panel axis to 90 degrees.

5. The sprinkler as claimed in claim 2, wherein the cover further has two protruding recesses formed in a side edge of the cover and respectively corresponding to and mounted around the positioning parts of the casing and the regulating wheels.

6. The sprinkler as claimed in claim 4, wherein the cover further has two protruding recesses formed in a side edge of the cover and respectively corresponding to and mounted around the positioning parts of the casing and the regulating wheels.

7. The sprinkler as claimed in claim 5, wherein each regulating wheel further has an operating lever radially protruding from the peripheral edge of the regulating wheel.

8. The sprinkler as claimed in claim 6, wherein each regulating wheel further has an operating lever radially protruding from the peripheral edge of the regulating wheel.

9. The sprinkler as claimed in claim 7, wherein each positioning part of the casing further has a pivot hole formed in the positioning part;

each regulating wheel further has a pivot hole formed through the regulating wheel and aligning with the pivot hole of a corresponding positioning part; and the sprinkling device further has two fasteners respectively mounted through the pivot holes of the regulating wheels and the positioning parts and attached to the casing.

10. The sprinkler as claimed in claim 8, wherein each positioning part of the casing further has a pivot hole formed in the positioning part;

each regulating wheel further has a pivot hole formed through the regulating wheel and aligning with the pivot hole of a corresponding positioning part; and the sprinkling device further has two fasteners respectively mounted through the pivot holes of the regulating wheels and the positioning parts and attached to the casing.

11. The sprinkler as claimed in claim 1, wherein the casing further has multiple latches formed on the outer surface and beside the outlet holes of the casing; and the cover further has multiple retaining grooves formed in an inner surface of the cover and respectively engaging the latches of the casing.

12. The sprinkler as claimed in claim 2, wherein the casing further has multiple latches formed on the outer surface and beside the outlet holes of the casing; and the cover further has multiple retaining grooves formed in an inner surface of the cover and respectively engaging the latches of the casing.

13. The sprinkler as claimed in claim 3, wherein the casing further has multiple latches formed on the outer surface and beside the outlet holes of the casing; and the cover further has multiple retaining grooves formed in an inner surface of the cover and respectively engaging the latches of the casing.

14. The sprinkler as claimed in claim 4, wherein the casing further has multiple latches formed on the outer surface and beside the outlet holes of the casing; and the cover further has multiple retaining grooves formed in an inner surface of the cover and respectively engaging the latches of the casing.

15. The sprinkler as claimed in claim 1, wherein the sprinkler further has a frame having a positioning hole formed through a rear end of the frame; and a mounting recess formed in a lower surface adjacent to a front end of the frame;

the sprinkling device is mounted between the front and rear ends of the frame;

the end cap is mounted in the positioning hole of the frame; and the inlet controlling device is securely mounted in the mounting recess of the frame.

16. The sprinkler as claimed in claim 2, wherein the sprinkler further has a frame having a positioning hole formed through a rear end of the frame; and a mounting recess formed in a lower surface adjacent to a front end of the frame;

the sprinkling device is mounted between the front and rear ends of the frame;

the end cap is mounted in the positioning hole of the frame; and the inlet controlling device is securely mounted in the mounting recess of the frame.

17. The sprinkler as claimed in claim 3, wherein the sprinkler further has a frame having a positioning hole formed through a rear end of the frame; and a mounting recess formed in a lower surface adjacent to a front end of the frame;

the sprinkling device is mounted between the front and rear ends of the frame;

the end cap is mounted in the positioning hole of the frame; and the inlet controlling device is securely mounted in the mounting recess of the frame.

18. The sprinkler as claimed in claim 4, wherein the sprinkler further has a frame having a positioning hole formed through a rear end of the frame; and a mounting recess formed in a lower surface adjacent to a front end of the frame;

the sprinkling device is mounted between the front and rear ends of the frame;

the end cap is mounted in the positioning hole of the frame; and the inlet controlling device is securely mounted in the mounting recess of the frame.

19. The sprinkler as claimed in claim 2, wherein each positioning parts of the casing further has a holding recess formed in the positioning part;

a holding rod mounted in the holding recess; and a resilient element mounted in the holding recess and pushing the holding rod outwardly; and each regulating wheel further has multiple holding indentations formed in an inner surface of the regulating wheel and corresponding to and selectively engaging the holding rod of the corresponding positioning part.

20. The sprinkler as claimed in claim 4, wherein each positioning parts of the casing further has a holding recess formed in the positioning part;

a holding rod mounted in the holding recess; and a resilient element mounted in the holding recess and pushing the holding rod outwardly; and each regulating wheel further has multiple holding indentations formed in an inner surface of the regulating wheel and corresponding to and selectively engaging the holding rod of the corresponding positioning part.

* * * * *